US005122289A

United States Patent [19]

Mackenzie et al.

[11] Patent Number: 5,122,289

[45] Date of Patent: Jun. 16, 1992

[54] COLLECTOR COMPOSITION FOR USE IN A FROTH FLOTATION PROCESS FOR THE RECOVERY OF MINERALS

[75] Inventors: James M. W. Mackenzie, Sandton; Peter J. Cabassi, Transvaal, both of South Africa

[73] Assignee: Henkel Kommanditgesellschaft auf Aktien, Duesseldorf-Holthausen, Fed. Rep. of Germany

[21] Appl. No.: 455,710

[22] Filed: Feb. 5, 1990

Related U.S. Application Data

[62] Division of Ser. No. 215,961, Jul. 7, 1988, Pat. No. 4,908,125.

[30] Foreign Application Priority Data

Jul. 7, 1987 [ZA] South Africa ..... 87/4930

[51] Int. Cl.[5] ..... B03D 1/01; B03D 1/012; B03D 1/014; B03D 1/008

[52] U.S. Cl. ..... 252/61; 209/166

[58] Field of Search ..... 209/166, 167, 901; 252/61

[56] References Cited

U.S. PATENT DOCUMENTS

| | | | |
|---|---|---|---|
| 2,074,699 | 3/1937 | Lehner | 209/166 |
| 2,185,968 | 1/1940 | Ralston et al. | 209/166 |
| 2,267,307 | 12/1941 | Ralston | 209/166 |
| 2,278,020 | 3/1942 | Ralston et al. | 209/166 |
| 2,289,996 | 7/1942 | Ralston et al. | 209/166 |
| 3,072,256 | 1/1963 | Gotte | 209/167 |
| 4,036,746 | 7/1977 | Strow et al. | 209/166 |
| 4,208,487 | 6/1980 | Wang | 209/166 |
| 4,324,654 | 4/1982 | Rule | 209/166 |
| 4,684,459 | 8/1987 | Klimpel et al. | 209/166 |
| 4,789,466 | 12/1988 | Von Rybinski | 209/166 |
| 4,797,202 | 1/1989 | Klimpel et al. | 209/166 |
| 4,830,739 | 5/1989 | Hellsten et al. | 209/166 |
| 4,877,518 | 10/1989 | Bresson | 209/167 |
| 4,883,585 | 11/1989 | Bresson et al. | 209/166 |
| 4,908,125 | 3/1990 | Mackenzie et al. | 209/166 |
| 4,929,344 | 5/1990 | Fleming | 209/166 |
| 4,946,585 | 8/1990 | Lambert | 209/166 |

FOREIGN PATENT DOCUMENTS

| | | |
|---|---|---|
| 917361 | 7/1954 | Fed. Rep. of Germany . |
| 1011166 | 6/1952 | France . |
| 8703221 | 6/1987 | World Int. Prop. O. . |

*Primary Examiner*—Ivars Cintins
*Assistant Examiner*—Thomas M. Lithgow
*Attorney, Agent, or Firm*—Ernest G. Szoke; Wayne C. Jaeschke; Norvell E. Wisdom, Jr.

[57] ABSTRACT

The invention is a collector composition for a flotation process containing a primary or secondary amine or amine salt and at least one of xanthates, dithiophosphates, mercaptobenzothiazoles, xanthogen format and thiococarbamate and a flotation process which utilizer the collector composition.

15 Claims, 4 Drawing Sheets

COLLECTOR COMPOSITION FOR USE IN A FROTH FLOTATION PROCESS FOR THE RECOVERY OF MINERALS

This application is a division, of application Ser. No. 07/215,961, filed Jul. 7, 1988. U.S. Pat. No. 4,908,125.

BACKGROUND OF THE INVENTION

1. Field of the Invention:

This invention relates to a collector composition for use in the froth flotation recovery of minerals, in particular of sulphide minerals such as pyrite, chacopyrite and pentlandite and of gold, from ores. It further relates to a flotation agent and to a froth flotation process.

DESCRIPTION OF THE INVENTION

In accordance with this invention there is provided a froth flotation process for recovering selected minerals from ores, which process comprises mixing with a flotation feed comprising a ground pulp of the finely divided ore and water, a collector composition which comprises at least one reagent of a first group consisting of primary amines of the formula R—$NH_2$, secondary amines of the formula $R_1R_2NH$ where each of R, $R_1$ and $R_2$ is an alkyl group of form 8 to 22 carbon atoms, and the salts of said primary and secondary amines, and a second reagent comprising at least one member of a second group consisting of xanthates, dithiophosphates, mercaptobenzothiazoles, xanthogen formates, and thionocarbamates.

The process may include adding to the flotation feed, a frother for stabilizing the froth or foam during froth flotation. The process may further include adding to the flotation feed, a pH modifier for establishing a suitable pH to enhance the effect of the first and second group members being used and thereby to enhance recovery of the desired mineral. The pH modifier may be, for example, sodium silicate, lime (CaO), caustic (NaOH) or an appropriate acid, such as the mineral acids such as sulfuric acid. Furthermore, the process may include adding to the flotation feed, a depressing agent (here in after referred to as "depressant") which may be ACROL J2P 350, or any other suitable depressant. Copper sulphate may also be added to the flotation feed both to activate sulphide minerals and to beneficially modify the froth structure.

"ACROL" J2P 350 is a registered trademark of Henkel Kommaditgesellschaft Auf Aktein. It is a chemically modified guar gum having a linear chain of $\beta$-D-mannopyranol units linked (1–4) with single membered $\alpha$-D-galacto-pyranosyl occurring as side branches. The chemical modification includes depolymerisation of guar gum to reduce the molecular weight and the substitution of anionic groups in place of the hyroxyl groups in the guar gum structure. The degree of substitution is about 0.1.

In accordance with this invention there is further provided a collector composition for use in froth flotation of minerals for recovering a mineral from its ore, which comprises a mixture of at least one member selected from a first group consisting of unsubstituted primary amines of the formula RNH2, unsubstituted secondary amines of the formula $R_1R_2NH$, and the salts of said primary and secondary amines; and at least one member selected from a second group consisting of xanthates, dithiophosphates, mercaptobenzothiazoles, xanthogen formates, and thionicarbamates.

DETAILED DESCRIPTION OF THE INVENTION

Other than in the operating examples, or where otherwise indicated, all numbers expressing quantities of ingredients or reaction conditions used herein are to be understood as modified in all instances by the term "about".

The members of the first group in the collector composition can be alkyl primary amines of the formula.

$$R—NH_2$$

or a salt, such as an organic or mineral acid salt. Preferably the salt is an acetate or chloride salt thereof with R being an alkyl group of from about $C_8$ to about $C_{22}$ and/or alkyl secondary amines of the formula:

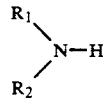

or a salt as defined afore, preferably the acetate or chloride salt thereof with each of $R_1$ and $R_2$ being an alkyl group or of from about of $C_8$ to about $C_{22}$.

The acid salts be the salts of the mineral acids such as sulfuric acid, phosphoric acid, hydrochloric acid or organic acids such as the alkanoic acids such as formic acid, acetic acids propanoic acid and the like. Acetic acid salts and hydrochloride salts are preferred.

It will be appreciated that the collector composition can include mixtures of primary alkyl amines of different chain lengths and/or salts thereof, and/or mixtures of secondary alkyl amines of different chain lengths and/or salts thereof, selected from the first group.

The proportion by weight, in the collector composition, of the member(s) selected from the first group may be between 10% and 90%, by weight and of the member(s) selected from the second group may be between 10% and 90% by weight. In a preferred process of the invention, the weight ratio of the first reagent to the second reagent is at least 1:4 and most preferrably 1:1.

In a typcial gold recovery process, for example, the first reagent is a soft primary tallow amine acetate which is added to the flotation feed in a concentration of 1 to 500 grams and preferrably 25 to 100 grams per metric ton of rougher flotation feed solids, and the second reagent is added to the feed in a concentration of 1 to 500 grams and preferrably 25 to 100 grams per metric ton of rougher flotation feed solids.

It will be appreciated that the particular second group member(s) that can be selected for a collector mixture for a particular application will generally depend on the pH at which froth flotation is intended or desired to be carried out, and vice versa. Xanthates and dithiophosphate can be used over the pH range from about 6 to about 11. Xanthogen formates, thionocarbamates and mercaptobenzothiazoles can be used over the pH range of from about 2 to about 11. Xanthates and dithiophosphates perform best in a relatively alkaline medium. Mercaptobenzothiazoles perform best in relatively acid conditions, and xanthogen formates and thionocarbamates are effective in both alkaline and acid media.

The reagent of the second group can be water soluble or insoluble. The xanthates contemplated for use herein are the alkali metal alkyl xanthates preferrably a sodium or potassium alkylxanthate of the formula:

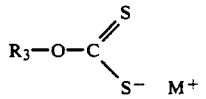

where $R_3$ is an alkyl group of from $C_2$ to $C_8$; M is an alkali metal preferrably sodium or potassium The dithiophosphates are the alkyl alkali metal dithiophosphates of the formula:

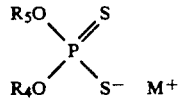

where $R_5$ and $R_4$ are independently selected alkyl groups of from $C_2$ to $C_8$ and M is an alkali metal as defined above.

The xanthogen formates can be in the form of the dialkyl xanthogen formates of formula

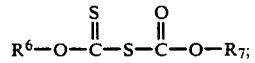

wherein $R_6$ and $R_7$ are an alkyl group of from 1 to 8 carbon atoms,. with the same preferred groups. The thionocarbamates can be in the form of the dialkyl thionocarbamates of formula

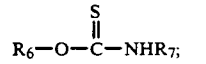

wherein $R_6$ and $R_7$ are as defined above. The mercaptobenzothiazoles can be in the form of the alkali metal salts(M). The alkali metal salts (M) are as defined above. It is preferred that the sodium or potassium salts be used. The mercaptobenzothiazoles have the formula

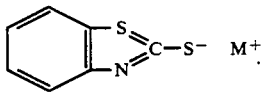

The xanthogen formates and the thionocarbamates are oily, water insoluble reagents, whereas the xanthates, dithiophosphates and mercaptobenzothiazoles are in the form of soluble alkali metal salts.

The flotation agent composition according to the invention can include a collector comprising a hydrocarbon oil selected from the group comprising neutral aliphatic hydrocarbon and aromatic hydrocarbon solvents preferably having distillation temperatures in the range 160° to 260° C. An example of such a hydrocarbon oil is a low aromatic content hydrocarbon solvent produced by the Chemical Division of Shell SA (Pty) Limited and marketed under the trade name "SHELLSOL K". "SHELLSOL K" has a distillation range of 190° C.-225° C.; an aromatic content of 0.5% V/V; a density at 20% C of 0.785 kg/liter; and a flash point of 65° C.

Furthermore, the collector composition according to the invention can also include a "frother" for stablizing the froth or foam during froth flotation.

The first reagent may be premixed with the hydrocarbon oil collector and the frother before being mixed into the flotation feed. Thus the process may include adding the first reagent to the flotation feed as a constituent of a mixture which comprises the first reagent, a collector in the form of a neutral hydrocarbon oil, and a frother.

The invention thus extends to a reagent mixture for use in froth flotation of minerals in conjunction with a reagent comprising at least one member of a group consisting of xanthates, dithiophosphates, mercaptobenziothiazoles, xanthogen formates and thionocarbamates, which reagent mixture includes a first collector comprising at least one member of a group consisting of unsubstituted primary and secondary amines and their salts;

a second collector comprising a neutral hydrocarbon oil; and a frother, in a ratio by weight of 5:4:1 respectively.

The frother can be any suitable, conventional frother. Examples of suitable frothers are the typical alcohol, polypropylene glycol, and ether frothers conventionally used in flotation, such as:

(a) methyl isobutyl carbinol of the formula

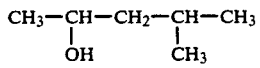

known in the trade as "MIBC", and obtainable at 97.5% purity from Shell SA (Pty) Ltd; (b) polypropylene glycol produced and marketed by Dow Chemical Africa (Pty) Ltd under the trade name "DOWFROTH 200"; and (c) tri-ethoxy-butane known in the trade as "TEB", and obtainable from Sentrachem Ltd., South Africa.

The invention extends to a flotation reagent composition which includes a collector composition according to the invention.

DOWFROTH 200 is a polypropylene glycol ether of the following formula:

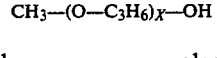

and has an average molecular weight of 200.

The preferred frother for the reagent mixture according to the invention is MIBC.

The invention extendes to a flotation reagent composition for a froth flotation process for recovering a mineral from an ore, which includes a collector composition according to the invention.

The flotation reagent composition may include a depressant for inhibiting the flotation of gangue minerals. The depressant, by adsorption or otherwise, combines with the gangue minerals to inhibit their flotation and thereby separates them from the mineral sought to be recovered. An example of a suitable depressant is "ACROL J2P 350". Other suitable depressants include dextrins and gums, such as guar gums.

The flotation reagent composition can also include a suitable pH modifier such as sodium silicate, a selected acid, or lime. It will be appreciated that the pH modifier should preferably be selected according to the particular mineral sought to be recovered and the particular flotation agent (especially the collector composition component thereof) being used, in order to provide a flotation medium of appropriate acidity or alkalinity. The flotation reagent components also can and preferably does include copper sulphate which acts as a beneficial sulphide mineral activator and froth modifier.

The process of the invention is particularly suitable for use with sulphide mineral ores, and for the recovery of gold, plantinum, uranium, copper, zinc, nickel, cobalt, silver, lead and iron.

BRIEF DESCRIPTION OF THE DRAWINGS

The invention is now described by way of the following non-limiting examples and with reference to the accompanying drawings in which.

The following Examples 1 to 9 of froth flotation were carried out using samples of gold ore having the same or substantially the same composition as that set out below.

| COMPOSITION OF GOLD ORE | | |
|---|---|---|
| Quartzite | 90–95% | by weight |
| Chlorite | 1–2% | by weight |
| Pyrhophylite | 3–5% | by weight |
| Cerrusite | 1–2% | by weight |
| Pyrite | 0.5–1.0% | by weight |
| Urananite | Trace) | |
| Kerogen | Trace) | 0.2% by weight |
| Carbon | Trace) | |
| Other sulphides (pyrrohtite, galena, chalcopyrite) | Trace) | |
| Gold | Trace | |
| Generic gangue classification is conglomerates. | | |

Furthermore, for the following examples, a soft primary tallow amine of formula $RNH_2$ was used as a collector, where R is an alkyl chain of the following approximate carbon chain length distribution:

$C_{10}$—0.5%
$C_{12}$—2.0%
$C_{14}$—3–5%
$C_{16}$—28–35%
$C_{18}$—58–67%

The iodine value was 35–55.

EXAMPLE 1

Froth Flotation of a South African Gold Ore

Figure 1:
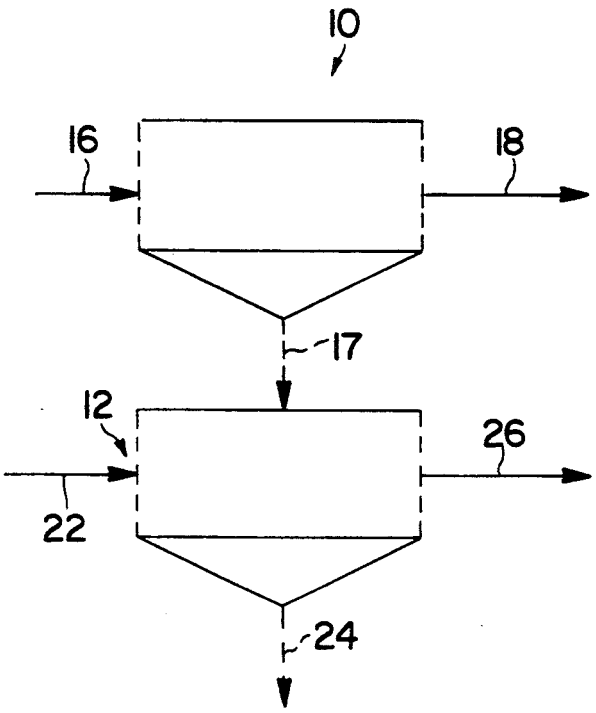
FIG. 1 is a flow diagram of the flotation process used in Examples 1 and 2.

A weighed amount of South African gold ore was ground in water to provide a pulp of the ore having a grind size of 70% minus 200 mesh and a pulp density of 38% solids by weight or specific gravity of 1.32. Rougher and cleaner flotation processes 10 and 12 were carried out in conventional manner in a Denver D12 laboratory flotation cell. The flotation processes are represented by way of a flow diagram in FIG. 1.

The rougher flotation process 10 was carried out in conventional manner with a rougher flotation feed 16 comprising water, ground ore and flotation reagents. The flotation reagents included a xanthate and a primary amine which together constituted a collector composition (a) according to the invention; a depressant (b); and a copper sulphate (c). Details of the reagents are given below.

Reagents added:

(a) A collector component according to the invention comprising sodium n-propyl xanthate (hereinafter referred to as SNPX) in an amount of 50 grams per metric ton of rougher flotation feed solids;

soft primary tallow amine acetate in an amount of 50 grams per metric ton of rougher flotation feed solids; and a frother consisting of 20 grams per metric ton of rougher flotation feed solids, of DOWFROTH 200;

(b) a gangue depressant in the form of ACROL J2P 350, in an amount of 10 grams per metric ton of rougher flotation feed solids;

(c) an activator/froth modifier, of 35 grams copper sulphate per metric ton of rougher flotation feed solids; and (d) lime (CaO) to adjust the pH of the flotation feed to 9.2.

The additives (b), (c) and (d) were added to the water and ground ore, separately from one another, as were the xanthate, amine and frother constituents of additives (a).

Fifteen minutes after initiation of the rougher flotation process 10, the rougher flotation feed 16 yielded a frother product comprising a rougher concentrate 17 which included gold and other mineral sulphides (e.g. iron sulphide) contaminated with a small and limited amount of gangue minerals and rougher tailings 18 comprising most of the gangue minerals initially present in the ground ore. The rougher concentrate 17 was separated from the rougher tailings 18 and samples of the rougher tailings 18 were dried and analysed by conventional means. The results of the analyses are given in Table 2 below.

The cleaner flotation process 12 was carried out on a cleaner flotation feed 22 comprising water and the rougher concentrate 17 together with further quantities of copper sulphate and ACROL J2P 350 (additives (d) and (e) below).

Reagents added for the cleaner flotation process 12:

(d) Copper sulphate in an amount of 5 grams per metric ton of rougher flotation feed 16 to activate sulphide minerals and modify the froth;

(e) ACROL J2P 350 in an amount of 10 grams per metric ton of rougher flotation feed 16.

Five minutes after initiation of the cleaner flotation process 12, the cleaner flotation feed 22 yielded a foam product comprising a cleaner concentrate 24 which included gold and other sulphide minerals contaminated with a reduced amount of gangue minerals, and cleaner tailings 26 comprising the residual gangue minerals from the rougher concentrate 17. Samples of the cleaner concentrate 24 and of the cleaner tailings 26 were dried and analysed by conventional methods, and the results are given in Table 2 below.

Unless otherwise specified, the additives listed in Table 1 were added to the rougher float for the rougher flotation process.

TABLE 1

Summary of ore characteristics and nature and quantities or additives for rougher and cleaner flotation processes

| | | |
|---|---|---|
| Ground ore: | grind size | 70% minus 200 mesh |
| | pulp density | 38% solids by weight or S.G. 1.32 |

TABLE 1-continued

| Summary of ore characteristics and nature and quantities or additives for rougher and cleaner flotation processes | | |
|---|---|---|
| Flotation Reagent Composition: | | |
| Collector: | SNPX | 50 grams/metric ton |
| and | primary amine acetate | 50 grams/metric ton |
| Frother: | DOWFROTH 200 | 20 grams/metric ton |
| Depressant: | ACROL J2P 350 | 60 grams/metric ton for rougher flotation<br>10 grams/metric ton for cleaner flotation |
| Activator/ Froth Modifier: | Copper sulphate | 35 grams/metric ton for rougher flotation<br>5 grams/metric ton for cleaner flotation |
| pH: | 9.2 | |
| Flotation time: | 15 minutes for rougher flotation process<br>5 minutes for cleaner flotation process | |

TABLE 2

Results of analyses after rougher and cleaner flotation

| | | GOLD | | TOTAL SULPHUR | |
|---|---|---|---|---|---|
| | % mass | Grade g/ton | % Recovery | Grade % S | % Recovery |
| Cleaner concentrate | 2.9 | 7.2 | 40.8 | 32.85 | 81.6 |
| Cleaner tailings | 2.9 | 1.98 | 11.2 | 3.19 | 7.9 |
| Rougher tailings | 94.2 | 0.26 | 48.0 | 0.13 | 10.5 |
| Calculated rougher feed | 100.0 | 0.511 | 100.0 | 1.17 | 100.0 |

In a continuous recovery process, the cleaner tailings 26 can be recirculated to be incorporated into the rough feed 16.

EXAMPLE 2

Flotation of another sample of the South African gold ore used in Example 1

Example 1 was repeated with the additives in Table 3 below. Unless otherwise specified, the additives listed in Table 3 were added to the rougher float and are expressed in terms of grams/metric ton of rougher feed solids.

TABLE 3

| Summary of ore characteristics and nature and quantities or additives for rougher and cleaner flotation processes | | |
|---|---|---|
| Ground ore: | grind size<br>pulp density | 70% minus 200 mesh<br>38% solids by weight or S.G. 1.32 |
| Flotation Reagent Composition: | | |
| Collector: | SNPX | 50 grams/metric ton |
| and | primary amine acetate | 25 grams/metric ton |
| and | SHELLSOL K (hydrocarbon oil) | 20 grams/metric ton |
| and | MIBC (frother) | 5 grams/metric ton |
| Additional Frother: | DOWFROTH 200 | 20 grams/metric ton |
| Depressant: | ACROL J2P 350 | 20 grams/metric ton for rougher flotation<br>10 grams/metric ton for cleaner flotation |
| Activator/ Froth Modifier | Copper sulphate | 35 grams/metric ton for rougher flotation<br>5 grams/metric ton for cleaner flotation |
| pH: | 9.2 | |
| Flotation time: | 15 minutes for rougher flotation process<br>5 minutes for cleaner flotation process | |

The primary amine acetate was mixed with the SHELLSOL K and MIBC prior to adding to the water and ground ore. A mixture of soft primary tallow amine acetate, SHELLSOL K and MIBC in liquid form and therefore easier to handle than the amine on its own (as used in Example 1) which has a paste-like consistency. Further, in this example in which the amine was used in conjunction with SHELLSOL K and MIBC, less amine by half was included in the rougher float, and yet the results compared favorably to those of Example 1. It will be appreciated that the cost of the froth flotation of Example 2 was significantly less than that of Example 1.

TABLE 4

Results of analyses after rougher and cleaner flotations

| | | GOLD | | TOTAL SULPHUR | |
|---|---|---|---|---|---|
| | % mass | Grade g/ton | % Recovery | Grade % S | % Recovery |
| Cleaner concentrate | 2.8 | 8.5 | 44.9 | 32.25 | 81.0 |
| Cleaner tailings | 2.0 | 1.78 | 6.7 | 2.5 | 4.5 |
| Rougher tailings | 95.2 | 0.27 | 48.4 | 0.17 | 14.5 |
| Calculated rougher feed | 100.0 | 0.53 | 100.0 | 1.12 | 100.0 |

EXAMPLE 3

Flotation of a South African gold ore

A measured amount of South Africa gold ore was ground in water to provide a plup of the ore with the following characteristics:

Grind size of ore: 70% minus 20% mesh

Pulp density: 24% solids by weight of S.G. 1.18

A collector composition according to the invention which is marketed by TROCHEM (a division of HENKEL S.A. (Pty) Ltd under the trade name "TROCOL S50" was prepared by mixing together:

| | weight ratio |
|---|---|
| soft primary tallow amine acetate | 50% |
| "SHELLSOL K" (i.e. neutral hydrocarbon oil) | 40% |
| MIBC | 10% |

Figure 2:
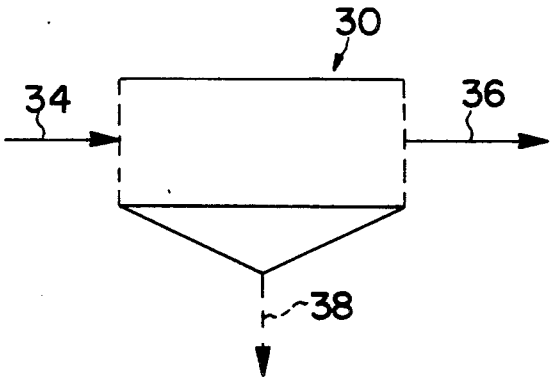
FIG. 2 is a flow diagram of a flotation process used in Examples 3 to 9.

A rougher flotation process 30 was carried out in conventional manner in a Denver D12 laboratory flotation cell and as represented by the flow diagram of FIG. 2, with a rougher feed 34 consisting of a mixture of:

the ground ore in water, 150 grams TROCOL S50 per metric ton rougher flotation feed solids, 50 grams copper sulphate a an activator/froth modifier per metric ton of rougher flotation feed solids, 100 grams ACROL J2P 350 as a gangue depressant per metric ton rougher flotation feed solids.

The pH of the rougher float was between 10.1 and 10.4

Ten minutes after initiation of the flotation process, the rougher flotation feed 34 yielded a foam product comprising a rougher concentrate 38 which included gold and other sulphide minerals such as iron sulphide contaminated with a limited amount of the gangue minerals present initially in the ground ore, and rougher tailings 36 comprising the vast majority of the gangue minerals.

The rougher concentrate 38 was separated in conventional manner from the rougher tailings 36. Samples of the rougher tailings 36 and rougher concentrate 38 were dried and analysed and the results are given below in Table 6.

The flotation process of Example 3 was not carried out in accordance with the process of the invention since a first group member of the collector composition according to the invention (i.e. as a constituent of the TROCOL S50) was added to the rougher float 32 but no second group member was added. Example 3 was carried out in order to provide results for comparison with the results of Examples 4 to 6 in which flotation processes according to the invention were used with both first and second group members being added to the rougher float 32.

EXAMPLES 4 to 7

Flotations of additional samples of the ground ore used in Example 3

Example 3 was repeated with the following variations:

In Examples 4 to 6, a collector composition according to the invention was used which comprised a mixture of TROCOL S50 and sodium ethyl xanthate in varying proportions by weight—see Table 5 below and the flotation process was carried out at a pH of 9.5. Example 7 was carried out with a collector composition comprising only sodium ethyl xanthate and no primary or secondary amine, for comparison purposes only.

TABLE 5

| Additives for the ground ore for Examples 3 to 7 (g/metric ton rougher float) | | | | |
|---|---|---|---|---|
| EXAMPLE NUMBER | SODIUM ETHYL XANTHATE | TROCOL S50 | COPPER SULPHATE | ACROL J2P 350 |
| 3 | — | 150 | 50 | 100 |
| 4 | 50 | 100 | 50 | 100 |
| 5 | 75 | 75 | 50 | 100 |
| 6 | 100 | 50 | 50 | 100 |
| 7 | 150 | — | 50 | 100 |

TABLE 6

| Results of analyses after the respective flotations of Examples 3 to 7 | | | | | | |
|---|---|---|---|---|---|---|
| | | | GOLD | | TOTAL SULFUR | |
| | | | Grade | | | |
| Example | Product | % weight | g/metric Ton | % Recovery | Grade % S | % Recovery |
| 3 | Rougher Conc. | 2.62 | 260.0 | 81.39 | 4.71 | 13.39 |
| | Rougher Tailings | 97.38 | 1.6 | 18.61 | 0.81 | 18.61 |
| | Calculated Feed | 100.00 | 8.4 | 100.00 | 0.91 | 100.00 |
| 4 | Rougher Conc. | 4.89 | 166.0 | 91.43 | 17.50 | 90.91 |
| | Rougher Tailings | 94.11 | 0.8 | 8.57 | 0.09 | 9.09 |
| | Calculated Feed | 100.00 | 8.9 | 100.00 | 0.94 | 100.00 |
| 5 | Rougher Conc. | 3.29 | 266.0 | 88.50 | 19.67 | 66.30 |
| | Rougher Tailings | 96.71 | 1.0 | 11.50 | 0.34 | 33.70 |
| | Calculated Feed | 100.00 | 8.4 | 100.00 | 0.98 | 100.00 |
| 6 | Rougher Conc. | 2.25 | 229.0 | 80.20 | 17.74 | 43.99 |
| | Rougher Tailings | 97.75 | 1.3 | 19.80 | 0.52 | 56.01 |
| | Calculated Feed | 100.00 | 6.4 | 100.00 | 0.91 | 100.00 |
| 7 | Rougher Conc. | 1.85 | 447.0 | 83.97 | 2.60 | 5.08 |
| | Rougher Tailings | 98.16 | 1.6 | 16.03 | 0.91 | 94.92 |
| | Calculated Feed | 100.00 | 9.8 | 100.00 | 0.94 | 100.00 |

Figure 3:
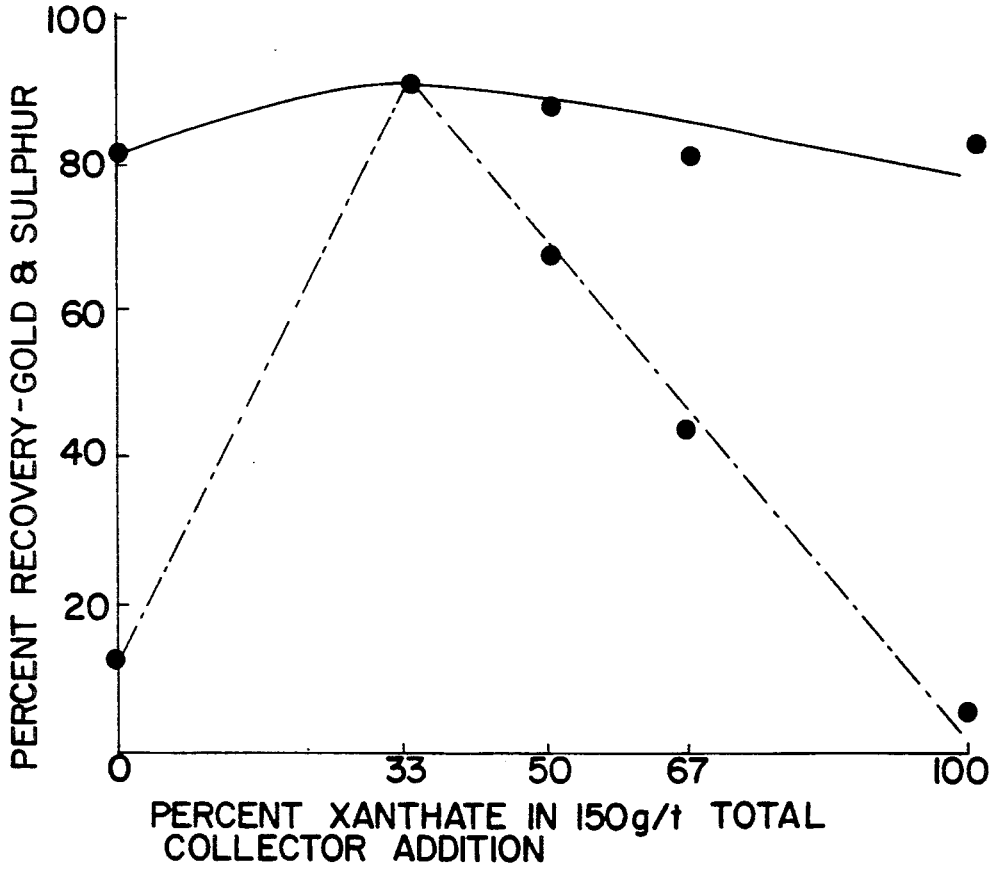
FIG. 3 is a graphic depiction of the results of Examples 3 to 7 below.

The % recovery figures for gold and total sulphur content were plotted on a graph which contitutes FIG. 3 of the drawings. It is clear from this graph that the recoveries of sulphur were enchanced when a collector composition of this invention, comprising a mixture of an amine (in the TROCOL S50) and a xanthate, was used in the flotation process instead of the amine without the xanthate (Example 3) or the xanthate without the amine (Example 7). The sulphur recovery decreased from Examples 4 to 6 as the proportion of Trocol in the flotation agent collector composition decreased. It is also clear from the graph that the recovery of gold was enhanced in Example 4 and 5 whereas, in Example 6, the gold recovery was slightly less than that of Examples 3 and 7. It is evident, therefore, that a preferred proportion of Trocol is in excess of 50% by weight of the xanthate present.

The results of the above examples suggest that some interreaction between the amine and the xanthate occurs. There appears to be an association, probably an ionic association between the two, although no chemical reaction is belived to take place. Further evidence of an inter-reaction or ionic association was obtained by conducting foaming tests.

These foaming tests comprised foaming a liquid mixture of sodium ethyl xanthate and a surfactant in a container by bubbling air through the liquid; allowing foam to spill over the top of the container; collecting the foam and measuring the concentration of xanthate therein; measuring the concentration of xanthate present in the residual liquid in the container; and calculating the concentration factor of xanthate in the froth. The results of the test are given in Table 7 below.

In the first of the tests, an anionic surfactant, dodecyl sulphate, was used at a pH of 9.2. In a second test, cationic dodecyl amine was used as the surfactant at a pH of 9.2. In a further eight tests (i.e. tests 3 to 10), soft primary tallow amine acetate (i.e. a cationic surfactant) was used at varying pH values and in varying proportions of surfactant to xanthate as set out in Table 7 below.

The concentration factor was calculated by dividing the xanthate concentration in the froth by the xanthate concentration in the residual liquid.

TABLE 7

| Surfactant added to xanthate solution | Test No | pH | Surfactant:Xanthate ratio in initial concentration | Concentration factor in froth |
|---|---|---|---|---|
| Dodecyl sulphate | 1 | 9.2 | 2:1 | 1.02 |
| Dodecyl amine | 2 | 9.2 | 2:1 | 2.24 |
| Soft primary tallow amine | 3 | 8.5 | 2:1 | 4.20 |

TABLEk 7-continued

| Surfactant added to xanthate solution | Test No | pH | Surfactant:Xanthate ratio in initial concentration | Concentration factor in froth |
|---|---|---|---|---|
| acetate | 4 | 8.5 | 1:1 | 3.60 |
| Soft primary tallow amine acetate | 5 | 9.2 | 2:1 | 3.20 |
| | 6 | 9.2 | 1:1 | 1.80 |
| | 7 | 9.2 | 0.50:1 | 1.80 |
| | 8 | 9.2 | 0.25:1 | 1.20 |
| Soft primary tallow amine acetate | 9 | 10.5 | 2:1 | 0.60 |
| | 10 | 10.5 | 1:1 | 0.70 |

As can seen from Table 7, and as expected, the anionic surfactant, dodecyl sulphate, did not interact or associate with the xanthate and consequently there was virtually no increase in the relative concentration of xanthate in the foam or froth. However, there was a significant increase in the concentration of xanthate in the foam when the cationic surfactants (i.e. the dodecyl amine and the primary amine acetate) were used at appropriate pH values. At pH 10.5 which is above the pKa of the amine salt used in these tests, the amine is no longer in cationic form and is therefore not expected to interact or associate with the xanthate anion.

EXAMPLES 8 and 9

Flotation of a South African gold ore

Example 3 was repeated with dithiophosphate substituted for xanthate in the proportions specified in Table 9 below and with a sample of cyclone underflow from a tertiary grinding circuit, substituted for the finer ground ore used in the previous examples and the additives specified in Table 8 below.

TABLE 8

| | | |
|---|---|---|
| Ground ore: | grind size | was that found in the cyclone underflow of a tertiary grinding cirucit |
| | pulp density | 68% solids by weight of S.G. 1.82 |
| Flotation Reagent Composition: | | |
| Collector | Di-isobutyl dithiophosphate | |
| Composition: | TROCOL S50 | |
| Additional Frother: | DOWFROTH 200 | |
| Depressant: | ACROL J2P 350 | |
| pH Modifier: | lime (i.e. CaO) | |
| pH: | 11 | |

TABLE 8-continued

| | |
|---|---|
| Flotation time: | 2 minutes |

Examples 8 and 9 exemplify what is termed "falsh flotation" for use when flotation of a small amount of a high grade concentrate is required. A flash flotation process, by definition, involves a relatively short flotation time. Accordingly the flotation times for Example 8 and 9 were as short as two minutes. A longer flotation time would have resulted in an increased yield of gold and sulphur but in a lower grade, larger amount of concentrate.

TABLE 9

| EXAMPLE NUMBER | Additives for the ground ore for Examples 8 and 9 (g/metric ton rougher float) DI-ISOBUTYL DITHIOPHOSPHATE | TROCOL S50 | DOWFROTH | ACROL J2P 350 200 |
|---|---|---|---|---|
| 8 | 10 | 20 | 30 | — |
| 9 | 10 | 40 | 30 | 10 |

TABLE 10

| Example Number | Product | % Weight | GOLD Grade g/metric Ton | GOLD % Recovery | TOTAL SULFUR Grade % S | TOTAL SULFUR Recovery |
|---|---|---|---|---|---|---|
| 8 | Rougher Conc. | 2.8 | 804.00 | 86.4 | 1.47 | 3.5 |
| | Rougher Tailings | 97.2 | 3.65 | 13.6 | 1.18 | 96.5 |
| | Calculated Feed | 100.0 | 26.10 | 100.0 | 1.19 | 100.0 |
| 9 | Rougher Conc. | 3.0 | 855.00 | 88.5 | 9.49 | 24.4 |
| | Rougher Trailings | 97.0 | 3.45 | 11.5 | 0.91 | 75.6 |
| | Calculated Feed | 100.0 | 29.00 | 100.0 | 1.17 | 100.0 |

As can be seen from Table 10, the % recovery of gold from the rougher concentrate when a collector comprising a primary amine and a dithiophosphate is used compares favourably with the % recovery of gold when a collector comprising a primary amine and a xanthate (see examples 4 to 6) is used. However the % recovery of sulphur from the rough concentrate in Examples 8 and 9 in which the dithiophosphate was used with the primary amine is significantly lower than that of Examples 4 to 6 in which the xanthate was used with the primary or secondary amine. Accordingly collector compositions comprising a mixture of a primary or secondary amine and a dithiophosphate in the absence of copper sulphate are more suitable for use in flotation systems in which recovery of sulphur is of secondary importance.

The following Examples 10 and 11 were carried out on reclaimed plant residue tailings which had been dumped from a gold recovery process some years before, and in which the residual cyanide had been oxidised by exposure to air.

EXAMPLE 10

Flotation of plant residue tailings

The example is illustrated with reference to FIG. 4. A measured weight of plant residue tailings from a previous gold recovery process was ground in water to provide a pulp of the ore having a grind size of 70% minus 200 mesh and a pulp density of 38% solids by weight or a specific gravity of 1.32. Sulphuric acid 48 was added to the water and ground ore to provide pH 4.0, and the resulting mixture was conditioned for six hours in a pachuca 49.

A first rougher flotation process 50.1 was carried out in conventional manner with a rougher flotation feed 52 comprising a mixture of:

the ground ore in water; and the following reagent composition 54:

a collector in the form of SENKOL 50, in an amount of 80 g per mertric ton of rougher flotation feed solids, a gangue depressant in the form of ACROL J2P 350, in an amount of 60 g per metric ton of rougher flotation feed solids, a frother in the form of DOWFROTH 200, in an amount of 20 g per metric ton of rougher flotation feed solids, and copper-sulphate in an amount of 60 g per metric ton of rougher flotation feed solids to activate sulphide minerals and modify the froth.

"SENKOL 50" is a trade mark for a sodium mercaptobenzothiazole reagent which is produced and marketed by Sentrachem Limited.

Five minutes after initiation of the rougher flotation process 50.1, the rougher flotation feed 52 yielded a froth product comprising a first, rougher concentrate 54.1 which included gold and other sulphide minerals contaminated with a limited amount of the gangue minerals present initially in the groundore. The rougher concentrate 54.1 was separated in conventional manner, and the rougher flotation process was allowed to continue as a second rougher flotation process 50.2, on the remaining flotation feed 52. Ten minutes thereafter, a further froth product collected at the surface of the flotation feed and comprised a second rougher concentrate 54.2 and rougher tailings 56 comprising the vast majority of the gangue minerals initially present in the plant residue tailings.

Figure 4:
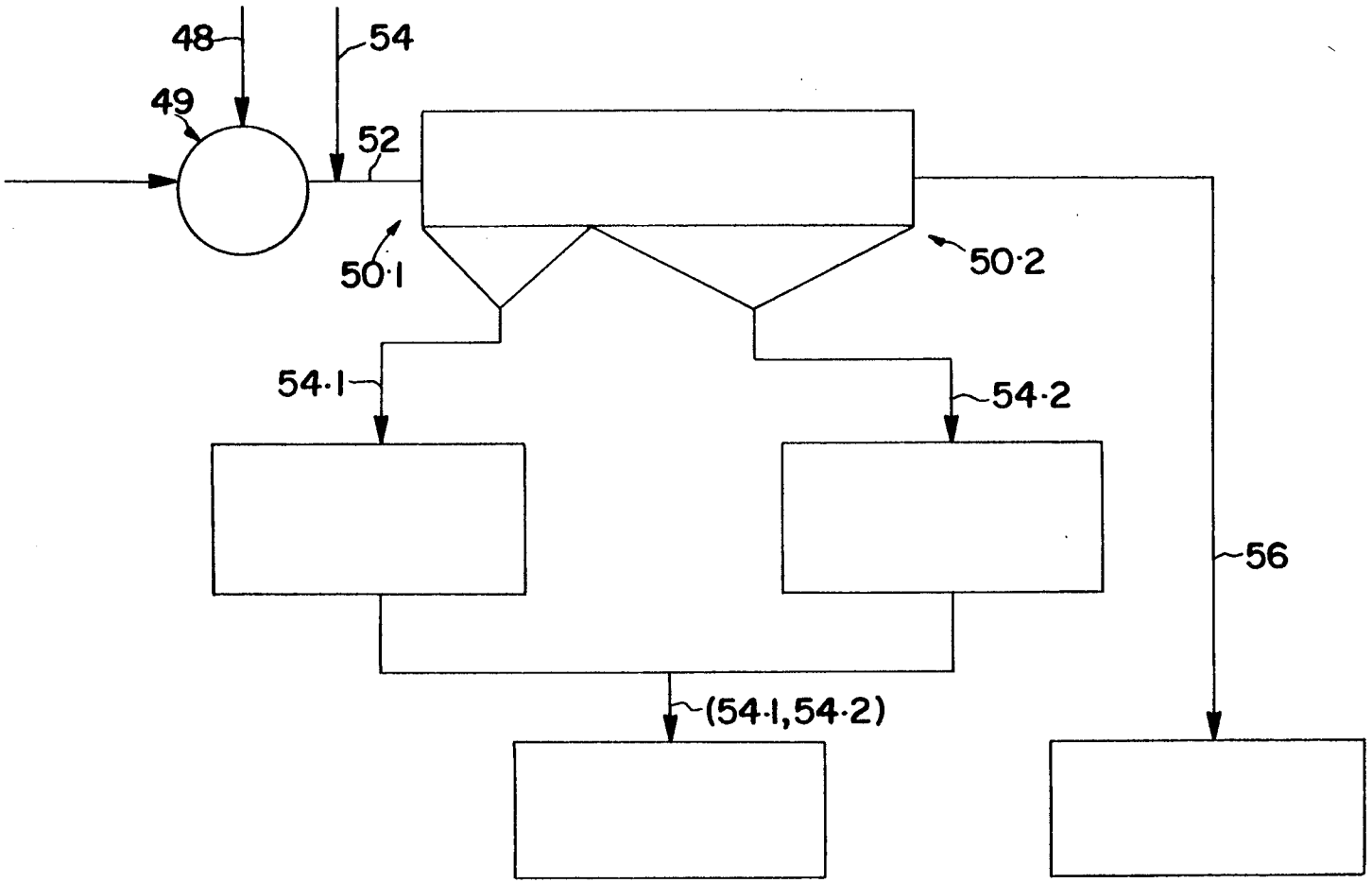
FIG. 4 is a flow diagram of a froth flotation process used in Example 10.

The first and second flotation processes 50.1, 50.2 were carried out in conventional manner and are represented by way of the flow diagram of FIG. 4.

The rougher concentrate 54.2, like the rougher concentrate 54.1, included gold and other sulphide minerals contaiminated with gangue minerals. The rougher concentrate 54.2 was separated from the rougher tailings 56.

Each of the rougher concentrate 54.1, rougher concentrate 54.2 and rougher tailings 56 were dried and analysed by conventional means. The results of the analyses are given in Table 12 below.

TABLE 11

Summary of Residue Tailings properties and quantities of additives for the first and second rougher flotation processes

| | | |
|---|---|---|
| Ground ore: | grind size | 70% minus 200 mesh |
| | pulp density | 38% solids by weight of S.G. 1.32 |
| Flotation Reagent Suite: | | |
| Collector: | Senkol 50 | 80 gm/metric ton |
| Frother: | DOWFROTH 200 | 20 gm/metric ton |

TABLE 11-continued

Summary of Residue Tailings properties and quantities of additives for the first and second rougher flotation processes

| | | |
|---|---|---|
| Depressant: | ACROL J2P 350 | 60 gm/metric ton |
| Activator/ Froth Modifier: | Copper sulphate | 60 gm/metric ton |
| Flotation pH: | 4.0 | |
| Flotation time: | 5 minutes for first rougher flotation<br>10 minutes for second rougher flotation | |

TABLE 12

Results of analyses after rougher and cleaner flotations

| | | GOLD | | TOTAL SULPHUR | |
|---|---|---|---|---|---|
| Product | % weight | Grade g/metric Ton | % Recovery | Grade % S | % Recovery |
| Rougher Conc. 1 | 1.6 | 5.20 | 21.1 | 28.76 | 55.0 |
| Rougher Conc. 2 | 1.7 | 5.25 | 22.7 | 11.92 | 24.2 |
| Combined Conc. | 3.3 | 5.22 | 43.8 | 20.08 | 79.2 |
| Rougher tailings | 96.7 | 0.23 | 56.2 | 0.18 | 20.8 |
| Calculated Feed | 100.0 | 0.40 | 100.0 | 0.83 | 100.0 |

EXAMPLE 11

Flotation of plant residue tailings

Figure 5:
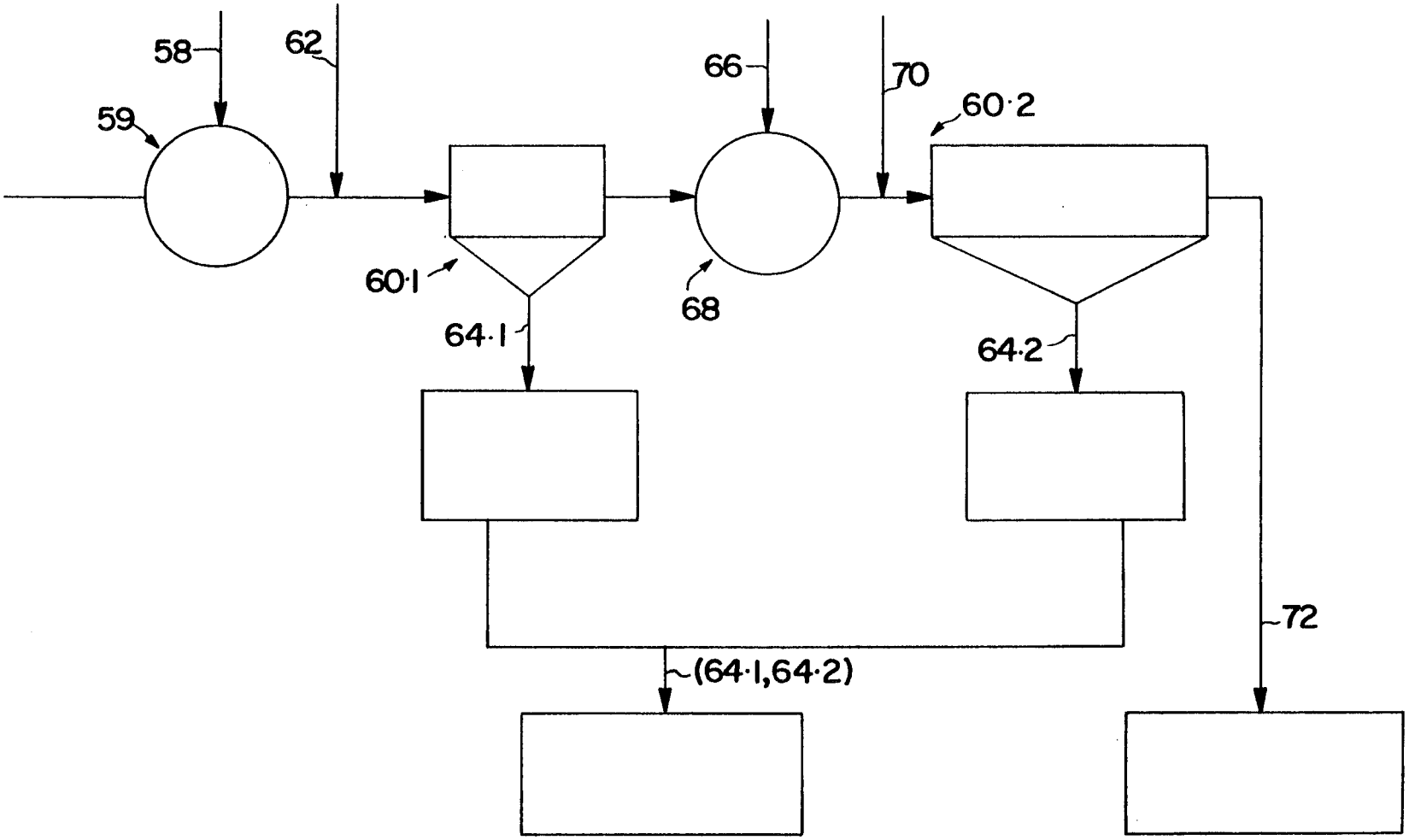
FIG. 5 is a flow diagram of a froth flotation process used in Example 11.

The example is illustrated by reference to FIG. 5.

A weighed amount of plant residue tailings from a previous gold recovery process was ground in water to provide a pulp of the ore. Lime 58 was added to the water and ground ore to provide pH 9.2, and the resulting mixture was conditioned for 45 minutes in a pachuca 59.

A first flotation process 60.1 was carried out as described for Example 10, but with the flotation reagent composition 62 according to the invention, and which is specified in Table 13A below. A rougher concentrate 64.1 was thereby provided.

After the first rougher flotation process 60.1, a second rougher flotation process 60.2 was carried out in conventional manner as described in Example 10 to provide a rougher concentrate 64.2. However, before the second flotation process 60.2 was allowed to proceed:

a) the pH of the remaining flotation feed was altered to pH 4 by adding sulphuric acid 66, and the feed was condition at this pH for about 45 minutes in a pachuca 68; and b) thereafter the constituents of the reagent composition 70 specifried in Table 13B were added.

As in Example 10, the second flotation process was allowed to continue for ten minutes before collecting the resulting second rougher concentrate 64.2 and rougher tailings 72.

TABLE 13

Summary of ore characteristics and quantities of additives for rougher first and second flotation processes

| A - FOR FIRST PROCESS | | |
|---|---|---|
| Ground ore: | grind size | 70% minus 200 mesh |
| | pulp density | 38% solids by weight or S.G. 1.32 |
| Flotation Reagent Suite: | | |
| Flotation Agent: | SNPX | 10 g/metric ton |
| and | TROCOL S50 | 30 g/metric ton |
| Frother: | DOWFROTH 200 | 12 g/metric ton |
| Depressant: | ACROL J2P 350 | 40 g/metric ton |
| Activator/ Froth Modifier: | Copper sulphate | 30 g/metric ton |

TABLE 13-continued

| Summary of ore characteristics and quantities of additives for rougher first and second flotation processes | | |
|---|---|---|
| pH regulator: | Lime (CaO) | |
| pH: | 9.2 | |
| Flotation time: | 5 minutes | |
| B - FOR SECOND PROCESS | | |
| Flotation Reagent Composition: | | |
| Collector: | SENKOL | 80 g/metric ton |
| Frother: | DOWFROTH 200 | 4 g/metric ton |
| Depressant: | ACROL J2P 350 | 60 g/metric ton |
| Activator/ Froth Modifier: | Copper sulphate | 30 g/metric ton |
| pH regulator: | sulphuric acid | |
| pH: | 4.0 | |
| Flotation time: | 10 minutes | |

TABLE 14

| Results after analysis of the flotation products | | | | | |
|---|---|---|---|---|---|
| | | GOLD | | TOTAL SULPHUR | |
| Product | % weight | Grade g/metric Ton | % Recovery | Grade % S | % Recovery |
| Rougher Conc. 1 | 1.0 | 10.55 | 26.61 | 25.3 | 34.5 |
| Rougher Conc. 2 | 1.8 | 6.00 | 25.9 | 20.46 | 47.8 |
| Combined Conc. | 2.8 | 7.63 | 51.2 | 22.65 | 82.3 |
| Rougher tailings | 97.2 | 0.21 | 48.8 | 0.14 | 17.7 |
| Calculated Feed | 100.0 | 0.42 | 100.0 | 0.77 | 100.0 |

As can be seen from Table 12 and 14, the combined % recovery of gold (i.e. 51.2%) from the rougher concentrate when a flotation agent according to the invention was used, is far superior to the % recovery of gold (i.e. 43.8%) when a conventional collector was used. It is notable that in the first five minutes of rougher flotation with the flotation agent according to the invention in alkaline medium (i.e. pH 9.2) the % gold recovery was higher than that achieved in the first five minutes of rougher flotation with a conventional collector in acid medium.

It is also clear from the results of Examples 10 and 11 that the % recovery of sulphur (i.e. 82.3%) was higher when the flotation agent according to the invention was used.

Furthermore, as can be seen from a comparison of Table 12 and 14, the gold and sulphur grades for the combined concentrates are higher in the instance where the collector according to the invention was used.

Advantages of the invention, as exemplified, include the efficacy and ease of use of the collector mixture, and the improved yield of the mineral sought to be recovered. The reagent mixture TROCAL is particularly useful in the practice of the invention.

In the flotation of ores and re-claimed tailings dumps where conventional flotation using xanthates or other sulphydryl collectors under alkaline pH conditions does not give satisfactory results, it is common practice to add acid and to float gold and sulphide minerals with collectors such as sodium mercaptobenzothiazoles. This involves additional cost in the form of the acid used and the lime required to neutralize the tailings. The use of the process and collector of the invention permits satisfactory flotation to be carried out under alkaline conditions and reduces the acidification and subsequent neutralization costs.

We claim:

1. A collector composition consisting essentially of:

(A) at least one member selected from the group consisting of unsubstituted primary amines of the formula $R—NH_2$ and unsubstituted secondary amines of the formula $R_1R_2—NH$ where each of R, $R_1$ and $R_2$ is an aliphatic hydrocarbyl group of $C_8$ to $C_{22}$ chain length, and the salts of said primary and secondary amines; and (B) at least one member selected from the group consisting of:

(1) xanthates of the formula:

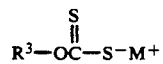

wherein $R^3$ is an alkyl group of from about 2 to about 8 carbon atoms and M is an alkali metal;

(2) dithiophosphates;

(3) mercaptobenzothiazoles;

(4) xanthogen formates; and (5) thionocarbamates.

2. A collector composition of claim 1 comprising at least one of the following:

(1) xanthates of the formula:

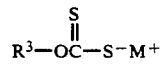

wherein $R^3$ is an alkyl group of from about 2 to about 8 carbon atoms and M is potassium or sodium;

(2) dithiophosphates of the formula:

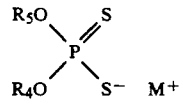

wherein $R_4$ and $R_5$ are independently alkyl of from about 2 to about 8 carbon atoms and M is potassium or sodium;

(3) xanthogen formates of the formula:

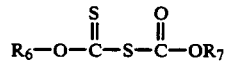

wherein $R_6$ and $R_7$ are independently selected alkyl groups of from 1 to about 8 carbon atoms;

(4) thionocarbamates of the formula:

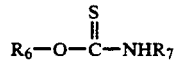

wherein $R_6$ and $R_7$ are independently selected alkyl groups of from 1 to about 8 carbon atoms; and (5) mercaptobenzothiazoles of the formula:

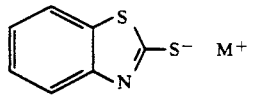

wherein M is an alkali metal ion.

3. A collector composition of claim 1, wherein component (A) comprises an acetate salt of the primary or secondary amine.

4. A collector composition of claim 1, wherein component (A) comprises a chloride salt of the primary or secondary amine.

5. A collector composition of claim 2, wherein component (B) is a xanthate of the formula:

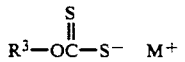

wherein $R^3$ is an alkyl group of from about 2 to about 8 carbon atoms, and M is Na or K.

6. A collector composition of claim 2, wherein component (B) comprises a dithiophosphate of the formula:

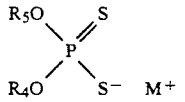

wherein $R_4$ and $R_5$ are each an independently selected alkyl group having from 2 to about 8 carbon atoms and M is Na or K.

7. A collector composition of claim 2, wherein component (B) comprises a dialkyl xanthogen formate of the formula:

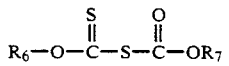

wherein $R_6$ and $R_7$ are each an independently selected alkyl group of 1 to 8 carbon atoms.

8. A collector composition of claim 2, wherein component (B) comprises a dialkyl thionocarbamate of the formula:

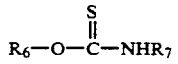

wherein $R_6$ and $R_7$ are each an independently selected alkyl group having from 1 to 8 carbon atoms.

9. A collector composition of claim 2, wherein component (B) comprises a mercaptobenzothiazole of the formula:

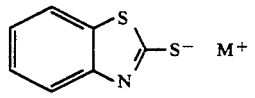

wherein M is Na or K.

10. A collector composition of claim 1, wherein the ratio by weight of component (A) to component (B) is at least 1:4.

11. A flotation agent comprising:

(A) a frother for stabilizing the froth, said frother being selected from the group consisting of a) methyl isobutyl carbinol, b) polypropylene glycol, and c) tri-ethoxy butane; and (B) a collector composition consisting essentially of:

(a) at least one member selected from the group consisting of unsubstituted primary amines of the formula $R—NH_2$ and unsubstituted secondary amines of the formula $R_1R_2—NH$ where each of R, $R_1$ and $R_2$ is an aliphatic hydrocarbyl group of $C_8$ to $C_{22}$ chain length, and the salts of said primary and secondary amines; and (b) at least one member selected from the group consisting of:

(1) xanthates of the formula:

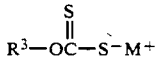

wherein $R^3$ is an alkyl group of from about 2 to about 8 carbon atoms and M is an alkali metal;

(2) dithiophosphates;

(3) mercaptobenzothiazoles;

(4) xanthogen formates; and (5) thionocarbamates.

12. A flotation agent according to claim 11, said flotation agent comprising a collector hydrocarbon solvent having a distillation temperature in the range of 160° C. to 260° C.

13. A flotation agent comprising a collector composition consisting essentially of:

(A) at least one member selected from the group consisting of unsubstituted primary amines of the formula $R—NH_2$ and unsubstituted secondary amines of the formula $R_1R_2—NH$ where each of R, $R_1$ and $R_2$ is an aliphatic hydrocarbyl group of $C_8$ to $C_{22}$ chain length, and the salts of said primary and secondary amines; and (B) at least one member selected from the group consisting of:

(1) xanthates of the formula:

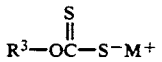

wherein $R^3$ is an alkyl group of from about 2 to about 8 carbon atoms and M is potassium or sodium;

(2) dithiophosphates of the formula:

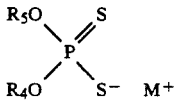

wherein $R_4$ and $R_5$ are independently alkyl of from about 2 to about 8 carbon atoms and M is potassium or sodium;

(3) xanthogen formates of the formula:

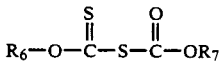

wherein $R_6$ and $R_7$ are independently selected alkyl groups of from 1 to about 8 carbon atoms;

(4) thionocarbamates of the formula:

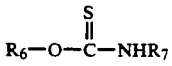

wherein $R_6$ and $R_7$ are independently selected alkyl groups of from 1 to about 8 carbon atoms; and (5) mercaptobenzothiazoles of the formula:

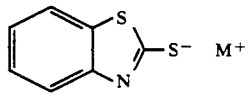

wherein M is an alkali metal ion, wherein component (A) comprises a soft primary tallow amine acetate and proportion by weight of component (A) in the flotation agent is between 10% and 90% and the proportion by weight of component (B) in the flotation agent is between 10% and 90%.

14. A flotation agent as claimed in claim 13, wherein component (B) is a propyl xanthate.

15. A flotation agent as claimed in claim 13, wherein component (B) is a dialkyl dithiophsophate.

* * * * *